US008469318B2

(12) United States Patent
Kaluscha

(10) Patent No.: US 8,469,318 B2
(45) Date of Patent: Jun. 25, 2013

(54) DEVICE FOR THE DETECTION OF THE OCCUPIED OR FREE STATE OF A TRACK SECTION

(75) Inventor: Uwe Kaluscha, Helmstedt (DE)

(73) Assignee: Siemens Aktiengesellschaft, Munich (DE)

( * ) Notice: Subject to any disclaimer, the term of this patent is extended or adjusted under 35 U.S.C. 154(b) by 303 days.

(21) Appl. No.: 12/994,285

(22) PCT Filed: May 13, 2009

(86) PCT No.: PCT/EP2009/055750

§ 371 (c)(1),
(2), (4) Date: Nov. 23, 2010

(87) PCT Pub. No.: WO2009/141251

PCT Pub. Date: Nov. 26, 2009

(65) Prior Publication Data

US 2011/0127388 A1 Jun. 2, 2011

(30) Foreign Application Priority Data

May 23, 2008 (DE) ..... 10 2008 025 188

(51) Int. Cl.
*B61L 1/14* (2006.01)
*B61L 1/18* (2006.01)

(52) U.S. Cl.
USPC ..... 246/122 R

(58) Field of Classification Search
USPC ..... 246/122 R, 169, 3, 34 R; 340/933, 340/988, 989; 701/19, 20
See application file for complete search history.

(56) References Cited

U.S. PATENT DOCUMENTS

| | | | | |
|---|---|---|---|---|
| 3,829,682 | A * | 8/1974 | Geiger | 246/125 |
| 3,868,075 | A * | 2/1975 | Blazek et al. | 246/34 CT |
| 3,888,437 | A * | 6/1975 | Birkin | 246/63 A |
| 4,325,524 | A * | 4/1982 | Krug | 246/34 R |
| 4,498,650 | A * | 2/1985 | Smith et al. | 246/122 R |
| 5,330,135 | A * | 7/1994 | Roberts | 246/34 R |
| 5,483,816 | A | 1/1996 | Nayer et al. | |
| 5,803,411 | A * | 9/1998 | Ackerman et al. | 246/169 R |
| 7,099,754 | B2 * | 8/2006 | Sugita et al. | 701/19 |
| 7,269,487 | B2 * | 9/2007 | Watanabe et al. | 701/19 |
| 7,975,968 | B2 * | 7/2011 | Bohlmann et al. | 246/122 R |

FOREIGN PATENT DOCUMENTS

| | | | |
|---|---|---|---|
| DE | 3134766 | A1 | 3/1983 |
| DE | 102008016962 | A1 | 10/2009 |
| EP | 0657337 | A1 | 6/1995 |
| EP | 1561663 | A1 | 8/2005 |

* cited by examiner

*Primary Examiner* — Mark Le
(74) *Attorney, Agent, or Firm* — Laurence A. Greenberg; Werner H. Stemer; Ralph E. Locher

(57) ABSTRACT

A device is configured to detect whether a track section is occupied or free. The device includes at least one transmitter on the vehicle side, and pairs of receivers on the track side, which are disposed at the ends of the track section, each having first and second receivers disposed at a distance in the track direction. The receivers receive signals from the transmitter as the vehicle passes. They are connected to an analysis unit. In order to ensure exact association between the track section ends and the current vehicle position, the invention provides that for a coupling range between the transmitter and the receiver, plus a maximum driving segment, which results from a minimum pulse duration of the receivers and a maximum segment speed, a response of the receivers during passage is preset such that the responses of the receivers of the receiver pair overlap in the event of increase of the coupling range due to an error.

3 Claims, 2 Drawing Sheets

DEVICE FOR THE DETECTION OF THE OCCUPIED OR FREE STATE OF A TRACK SECTION

BACKGROUND OF THE INVENTION

FIELD OF THE INVENTION

The invention relates to an apparatus for detecting whether a track section is occupied or free, having at least one vehicle-side transmitter and trackside receiver pairs, which are arranged at the ends of the track section and each have first and second receivers which are separated in the track direction, wherein the receivers receive signals from the transmitter when the vehicle passes, and are connected to an evaluation device.

The track-free signal represents a major decision criterion for the control of points and signals. The occupancy state of the track sections is used to decide whether a rail vehicle may or may not enter this track section. The basic aim is to prevent collisions between vehicles by driving into one another from opposite directions or from the side. For this purpose, it is necessary to ensure that only one vehicle is ever located on a defined section of the track. The entry of other vehicles to this track section which is occupied by a vehicle must be refused. This is the traditional task of a signal box. For this purpose, the signal box requires safety information as to which track sections are occupied and which are free.

In order to detect the presence of a vehicle, in particular a vehicle with rubber tires, on a track section, the unpublished 2008P04438DE proposes that transmitting means be arranged on the vehicle side and that receiving means be arranged on the track side, at the start and at the end of the track section, with the receiving means receiving signals from the transmitting means when the vehicle passes, and supplying them to an evaluation device. This allows a track-free signaling system to be designed which, in contrast to axle counters or track circuits, is not based on the presence of metallic vehicle wheels or axles. However, this track-free signaling system is subject to the problem of guaranteeing that the defined transmission and reception range, that is to say the coupling range between the transmitter and receiver, does not change without being noticed. One critical factor in particular here is to increase the coupling range. It is therefore not possible to prevent a vehicle signaling that it is departing from a track section even though it is well away from the assumed position at the end of the track section and, in consequence, this track section is still occupied. A dangerous increase in the coupling range can be caused both by the transmission level of the transmitter drifting away and by the sensitivity of the receivers drifting away from the defined limits.

BRIEF SUMMARY OF THE INVENTION

The invention is based on the object of overcoming these disadvantages and of specifying a track-free signaling device of this generic type in which an increase in the coupling range can be detected in real time, thus making it possible to prevent premature signaling that a track section which is still occupied is free.

According to the invention, the object is achieved in that a response of the receivers during the passage with a coupling range between the transmitter and the receiver plus a maximum travel distance, which results from a minimum pulse duration of the receivers and a track maximum speed, is preset such that, if the coupling range increases as a result of a fault, this results in an intersection of the response of the receivers in the receiver pair. This ensures that the track-free signaling device is checked for a critical increase in the coupling range whenever a vehicle passes by. There is no additional effort for regularly measuring the instantaneous coupling range in situ. There is no need for servicing measures of this type, and when particular advantage of the claimed solution is that faults can be detected in real time.

In the end, this therefore allows a higher safety level to be achieved than when the coupling range is checked at long time intervals. A further advantage is that the interaction of both vehicle components and track components is effectively checked. The system tolerance corresponds only to the travel distance which is preset as the minimum pulse duration in conjunction with the response of the receivers. The pulse duration and the travel distance which results from this at the maximum track speed should be chosen to be as small as possible since intersection of the ready-to-receive states of the adjacent receivers can be detected even when there is minor increase in the coupling range. In the final analysis, the track can therefore be better optimized for vehicles passing through. Even at the start of an intersection of the response of the receivers, that is to say when transmitted signals are received at the same time by both receivers in the receiver pair, countermeasures can be provided to return the coupling range to the intended order of magnitude. In this case, it is easily possible to decide whether the coupling range has resulted from an increased transmission level of the vehicle-side transmitter or from an increase in the sensitivity of a trackside receiver, by evaluating a plurality of passages of different vehicles.

One claimed embodiment provides not only for the receivers to be arranged in pairs, but also the transmitters. This redundant configuration of the transmitters and receivers provides adequate safety for the production of the track-free signals to be evaluated even when the transmitters and/or the receivers are not designed to be safe for signaling purposes.

In order to comply with the stringent requirements for system safety, the receivers as claimed in one embodiment are connected to an evaluation device, which is safe from the signaling point of view in a signal box, wherein the responses of the two receivers in a receiver pair are AND-linked. The signal box preferably receives redundant information, which complies with the required very stringent safety level for the track-free signal by means of the evaluation within the signal box, which is normally safe for signaling purposes. The AND-linking makes it possible to determine in a simple manner whether both receivers are producing output information at the same time.

BRIEF DESCRIPTION OF THE SEVERAL VIEWS OF THE DRAWING

The invention will be explained in more detail in the following text with reference to illustrations in the figures, in which.

DESCRIPTION OF THE INVENTION

Figure 1:
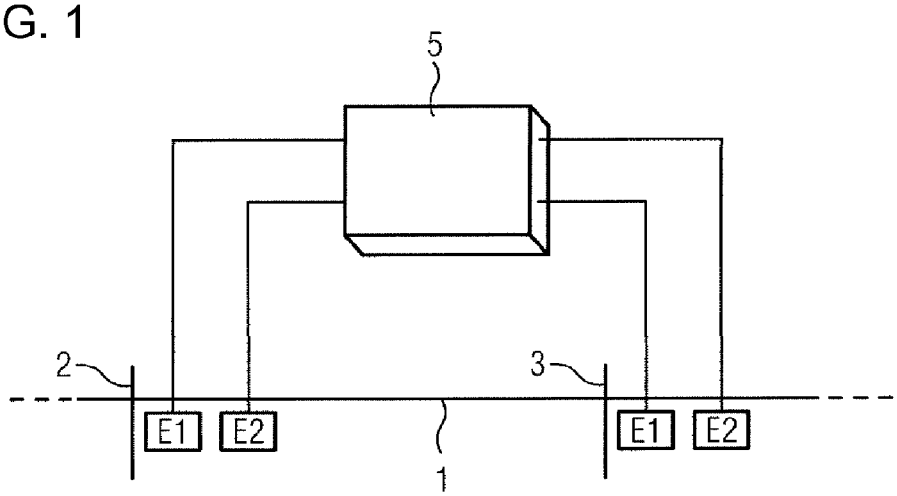
FIG. 1 shows the most important components of a track-free signaling system according to the invention.

FIG. 1 shows a track section 1, at each of whose ends 2 and 3 a pair of receivers, with receivers E1 and E2, are arranged.

When a vehicle 4 moves through this section (FIGS. 2 and 3), the receivers E1 and E2 produce output signals, which are supplied to a signal box 5 for evaluation.

Figure 2:
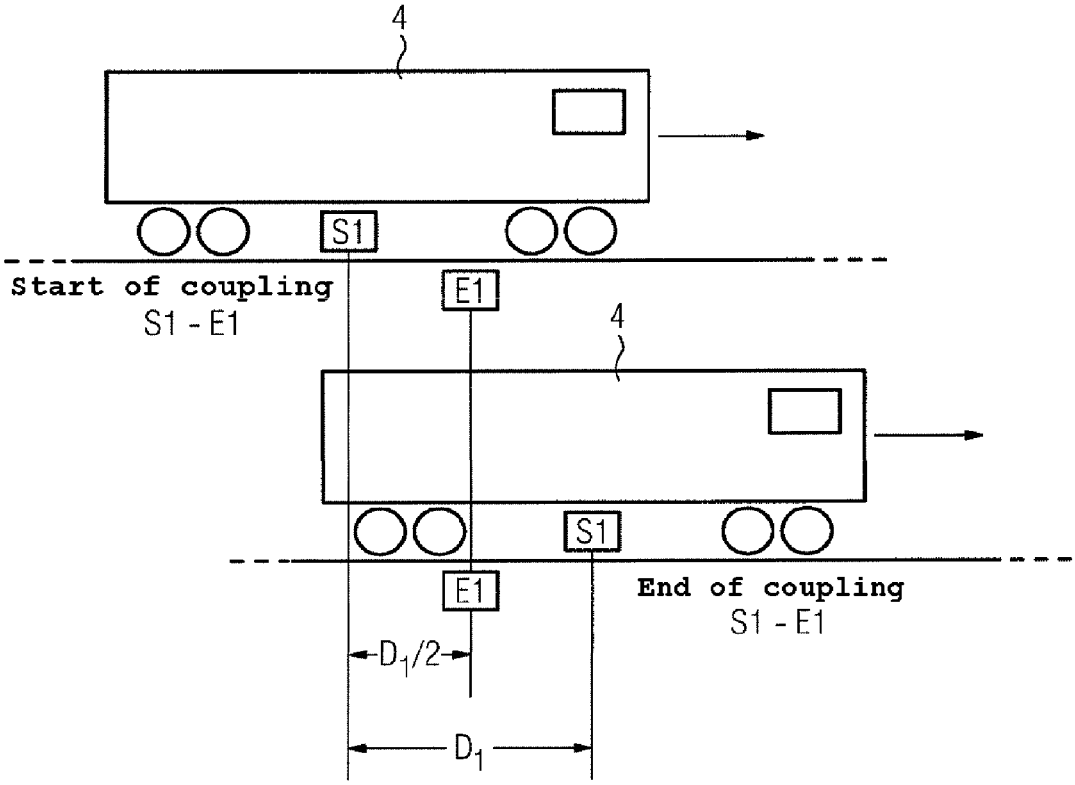
FIG. 2 shows the coupling range between a transmitter and a receiver.

As can be seen from FIG. 2, the vehicle 4 is equipped with a transmitter S1 which continuously emits transmitted messages, which are received by the track-side receiver E1 within the coupling range $D_1$. In this case, for simplicity, it is assumed that the coupling is symmetrical, that is to say that the coupling starts when the transmitter S1 has approached within half the coupling range $D_1/2$ of the receiver E1, and ends when the transmitter S1 is more than half the coupling range $D_1/2$ behind the receiver E1.

Figure 3:
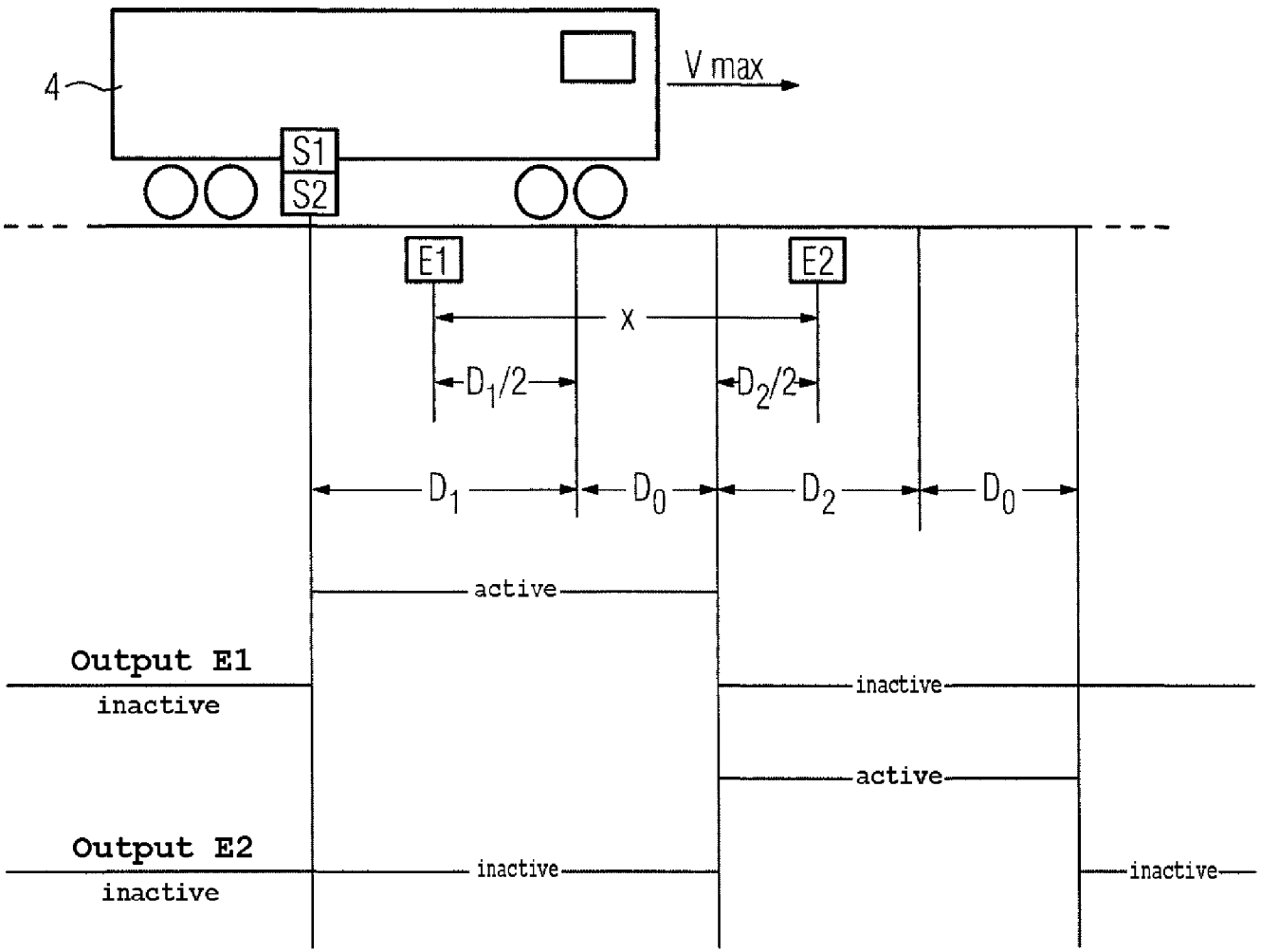
FIG. 3 shows a layout scheme of the receivers and their activation.

The response of the receiver E1, that is to say the time during which the output signal is emitted, corresponds to the duration of the coupling plus a time $t_0$, wherein a maximum travel distance $D_0$ can be traveled through during this time $t_0$, for which $D_0=t_0 \bullet v_{max}$, where $v_{max}$ is the maximum permissible speed for this track section. This relationship is illustrated in FIG. 3. FIG. 3 shows a constellation with redundant transmitters S1 and S2, with both transmitters S1 and S2 being arranged alongside one another, when seen in the direction of travel, on the vehicle 4. The receivers E1 and E2 are able to distinguish between messages transmitted from the transmitters S1 and S2. The data messages from the first transmitter S1 can be evaluated only by the first receiver E1, and the data messages from the second transmitter S2 can be evaluated only by the second receiver E2. A further precondition is that single failures in the data transmission between S1 and E1 and between S2 and E2 are identified in the system and are handled for safety purposes such that only both transmissions together allow track-free signaling. The two receivers E1 and E2 must be laid with a minimum distance between them of $x=D_1/2+D_0+D_2/2$. In this arrangement, the response of the receivers E1 and E2, that is to say the activation of the receiver E1 or E2, is preset only for a travel distance $D_1+D_0$ or $D_2+D_0$. When operating correctly, the output from the receiver E1 is inactive when traveling through the distance $D_2+D_0$, while the output from the second receiver E2 is inactive when traveling through the distance $D_1+D_0$. If an increase in the coupling range $D_1$ occurs, this leads to lengthening of the activation phase $D_1+D_0$, thus resulting in the responses intersecting. The two receivers E1 and E2 then produce output information at the same time during this intersection. The outputs of the two receivers E1 and E2 can thus be simply linked logically in order that appropriate information can be identified from an increase in the coupling range $D_1$ and/or $D_2$, and can be used further for safety purposes. The described arrangement in this case detects both increases in the transmitter power on the vehicle 4 and an increase in the sensitivity of the receivers E1 and E2.

The invention claimed is:

1. An apparatus for detecting whether a given track section is occupied or free, comprising:

at least one vehicle-side transmitter;

trackside receiver pairs disposed at the ends of the track section, each receiver pair having first and second receivers separated in a track direction, said first and second receivers being operated in pulsed operation with a given minimum pulse duration, and said first and second receivers being disposed to receive signals from said at least one transmitter when the vehicle passes and said at least one transmitter is present within a coupling range between said at least one transmitter and said receivers; and an evaluation device connected to receive signals from said receivers;

wherein a maximum travel distance is defined by a minimum pulse duration of said receivers and a maximum speed allowable on the given track section; and wherein a response of said first and second receivers during a passage of the vehicle within the coupling range between said at least one transmitter and said receivers plus the maximum travel distance is preset such that, when the coupling range increases as a result of a fault, responses of said receivers in said receiver pair intersect each other.

2. The apparatus according to claim 1, wherein said at least one transmitter is one of a pair of transmitters.

3. The apparatus according to claim 1, wherein said evaluation device is connected in a secure signaling environment, and said evaluation device is configured to AND-link the responses of said first and second receivers of said receiver pair.

* * * * *